US011697531B2

(12) United States Patent
Gillespie et al.

(10) Patent No.: US 11,697,531 B2
(45) Date of Patent: Jul. 11, 2023

(54) DISPENSING LID

(71) Applicant: Zak Designs, Inc., Spokane, WA (US)

(72) Inventors: Andrew Gillespie, North Easton, MA (US); Tyler Noveletsky, East Falmouth, MA (US)

(73) Assignee: Zak Designs, Inc., Spokane, WA (US)

( * ) Notice: Subject to any disclaimer, the term of this patent is extended or adjusted under 35 U.S.C. 154(b) by 35 days.

(21) Appl. No.: 17/534,406

(22) Filed: Nov. 23, 2021

(65) Prior Publication Data

US 2023/0159235 A1 May 25, 2023

(51) Int. Cl.
*B65D 47/08* (2006.01)
*B65D 47/12* (2006.01)

(52) U.S. Cl.
CPC ..... *B65D 47/0871* (2013.01); *B65D 47/12* (2013.01); *B65D 2547/06* (2013.01)

(58) Field of Classification Search
CPC ..... B65D 33/25; B65D 33/2508; B65D 33/2516; B65D 33/2533; B65D 33/2541; B65D 33/2558; B65D 2517/0035; B65D 2583/0454; B65D 65/08; B65D 90/58; B65D 47/2087; B65D 47/2093; B65D 47/249; B65D 47/26; B65D 47/0871; B65D 47/12; B65D 2547/06
See application file for complete search history.

(56) References Cited

U.S. PATENT DOCUMENTS 5,083,672 A * 1/1992 Lewandowski ..... B65D 47/286 215/322
5,456,380 A * 10/1995 Ito ..... A47G 19/2272 220/717
6,050,433 A * 4/2000 Russell ..... B65D 47/2043 220/252
6,439,442 B1 * 8/2002 Markert ..... A01C 7/02 215/322
6,763,964 B1 * 7/2004 Hurlbut ..... A47G 19/2272 222/481.5

(Continued)

FOREIGN PATENT DOCUMENTS

CN 215099317 U 12/2021

OTHER PUBLICATIONS

"Starbucks Company Cold-To-Go Cup Accessory Lid Straw Alternative for Venti & Grande Tumbler," 3 pp., https://www.amazon.com/Starbucks-Company-Accessory-Alternative-Tumbler/dp/B08NZTT35, Accessed Sep. 13, 2021.

*Primary Examiner* — Kareen K Thomas
(74) *Attorney, Agent, or Firm* — Randall Danskin, P.S.

(57) ABSTRACT

A dispensing lid includes a port through the lid, a slider in sliding engagement with the lid, and a detent on the slider. The slider is selectively movable between a closed position that closes the port, an open position that opens the port, and removal from the lid. The detent includes a wall extending from the slider, a lever attached to the slider at a pivot, a pawl extending from the lever, and a catch extending from the pawl. The lever is in an orientation opposing the wall with a gap between the lever and the wall. The catch engages a first stop in the lid when the slider is in the closed position with the lever released, engages a second stop in the lid when the slider is in the open position with the lever released, and does not engage the lid when the slider is removed.

20 Claims, 8 Drawing Sheets

(56) References Cited

U.S. PATENT DOCUMENTS

| | | | | |
|---|---|---|---|---|
| 8,919,593 | B2 * | 12/2014 | Sinacori | B65D 47/286 220/264 |
| 8,985,370 | B2 * | 3/2015 | Lane | B65D 43/26 220/252 |
| 9,272,822 | B2 * | 3/2016 | Samartgis | B65D 47/148 |
| 10,004,348 | B2 * | 6/2018 | Sorensen | B65D 47/0847 |
| 10,512,347 | B1 * | 12/2019 | Shepard | B65D 47/066 |
| 11,577,892 | B2 * | 2/2023 | Wong | B65D 47/066 |
| 2003/0168455 | A1 * | 9/2003 | Zettle | B65D 47/0895 220/714 |
| 2014/0048549 | A1 * | 2/2014 | Wille | B65D 47/32 220/713 |
| 2015/0173539 | A1 * | 6/2015 | Mason | B65D 77/283 220/715 |
| 2015/0201776 | A1 * | 7/2015 | Elsaden | A47G 19/2272 220/715 |
| 2015/0282654 | A1 * | 10/2015 | Kurabe | A47G 19/2272 220/254.5 |
| 2015/0353230 | A1 * | 12/2015 | Strzelczyk | B65D 17/4014 215/322 |
| 2016/0207672 | A1 * | 7/2016 | Wong | B65D 43/0225 |
| 2016/0213178 | A1 * | 7/2016 | Maple | A47G 19/2272 |
| 2019/0210773 | A1 * | 7/2019 | Huang | B65D 47/249 |

* cited by examiner

DISPENSING LID

BACKGROUND

Various personal, liquid-dispensing containers and related covers or lids have been fabricated and sold over many decades. In the present day, such devices are often referred to generically as "water bottles," though they frequently contain liquids other than water, or simply "bottles." For many years, these personal, liquid-dispensing containers and their associated covers or lids, or water bottles, have been designed to meet the particular needs of users during their various events and activities. Water bottles have been designed to increase ease of use and comfort during drinking. For example, one water bottle described in CN Pat. App. No. 202023275216.9 shows in FIG. 9 of that reference a recessed lid that accommodates a user's nose to decrease the degree to which a user tilts their head back to empty the water bottle into their mouth.

At times, designs to increase the ease of use nevertheless decrease the ease of cleaning. With more complex structures to meet user needs often comes more difficult cleaning, especially when storing liquids other than water. Accordingly, designs that increase the ease of cleaning would be beneficial.

BRIEF DESCRIPTION OF THE DRAWINGS

Some embodiments are described below with reference to the following accompanying drawings.

DETAILED DESCRIPTION

One implementation for a dispensing lid that increases the ease of use as well as increases the ease of cleaning includes a removable slider with a detent enabling selection of a closed position, an open position, or removal from the lid. The removable slider disengages from the lid for easy cleaning of surfaces of the lid that interface with surfaces of the slider. Otherwise, residues may accumulate at the interface between the lid and the slider. Although known dispensing lids may include a slider, often the slider is pressed into place during manufacturing and is not considered removable by the user. Generally, attempted removal of such a slider results in damage to the slider, the lid, or both.

Even if a known slider might be removed without damage to the slider, the lid, or both, the opened and closed positions of known sliders are difficult to discern. Also, a known slider could accidentally slip into an open position when intended to remain a closed positon due to a weak engagement with the lid when in the closed position. The accidental opening may result in spillage. Similarly, a slider may accidentally slip past an open position and detach from the lid due to a weak engagement with the lid upon reaching the open position. The accidental detachment may result in soiling, damage, or loss of the slider.

Some examples described herein provide a detent on the slider. The detent may include a wall extending from the slider and a lever attached to the slider at a pivot and in an orientation opposing the wall with a gap between the lever and the wall when the lever is in a released position. A pawl extends from the lever and a catch extends from the pawl. The catch engages a first stop in the lid when the slider is in the closed position with the lever released, engages a second stop in the lid when the slider is in the open position with the lever released, and does not engage the lid when the slider is removed.

Therefore, some implementations described herein include a detent that provides a robust engagement with the lid. The detent may retain the slider in the closed position unless positively disengaged and may retain the slider in the open position unless positively disengaged. Accordingly, spilling of contents and soiling, damage, or loss of the slider may be reduced while still permitting slider removal, such as for cleaning.

Figure 1:
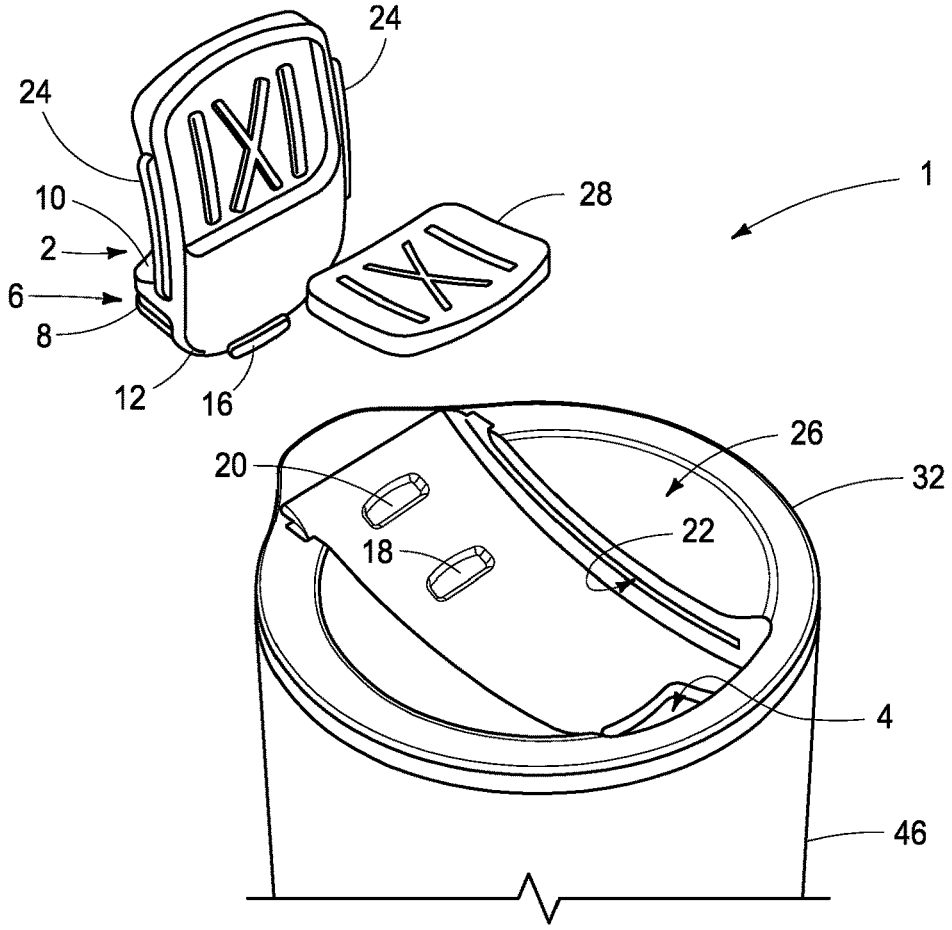
FIG. 1 is an exploded, isometric view of a dispensing lid, according to one implementation, engaged with a liquid container.
Figure 2:
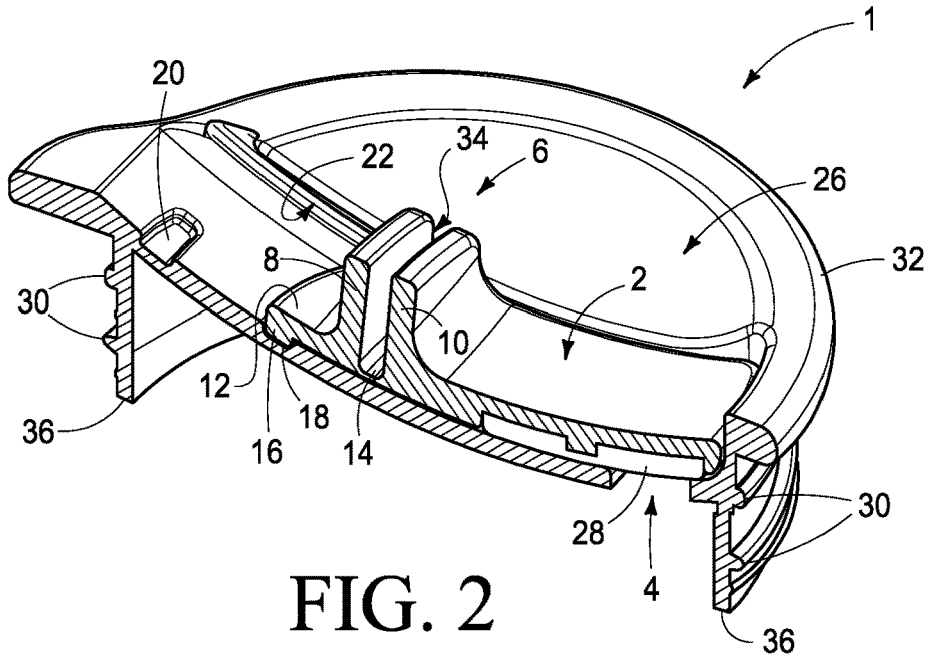
FIG. 2 is a cross-sectional, isometric view of the dispensing lid in FIG. 1.
Figure 3:
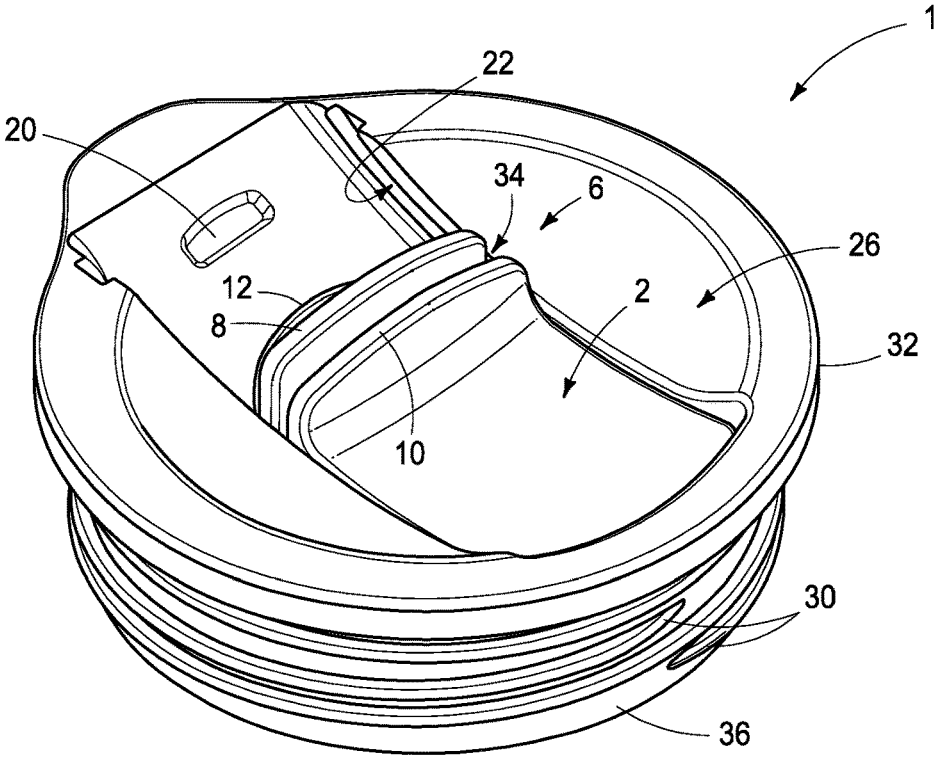
FIGS. 3-6 are isometric views of the dispensing lid in FIG. 1 with a slider 2 in various positions and modes of operation.
Figure 4:
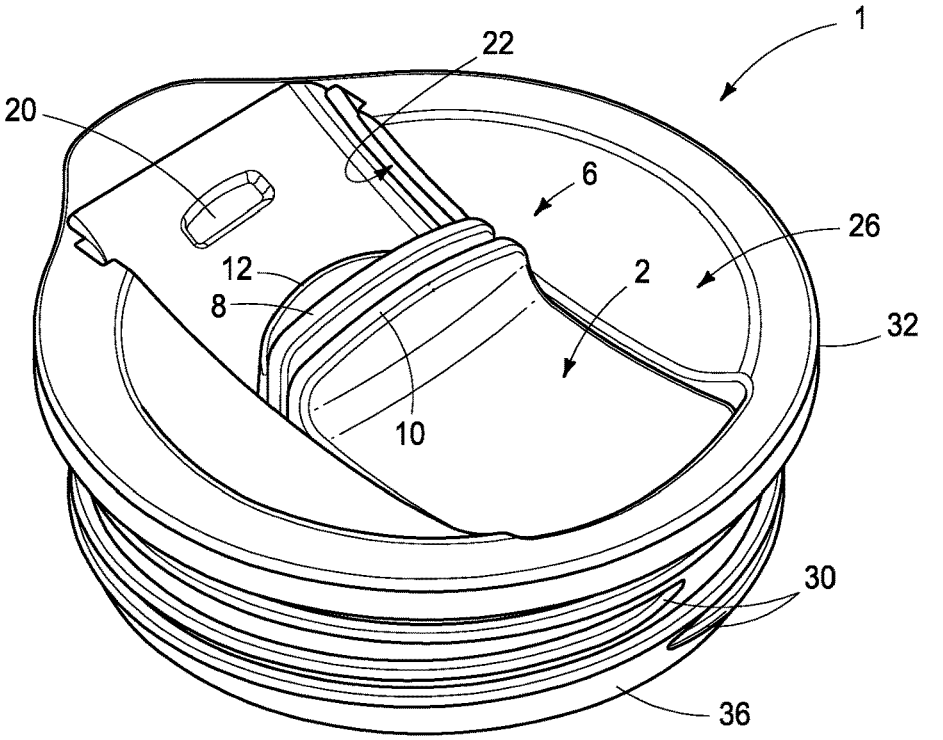
Figure 5:
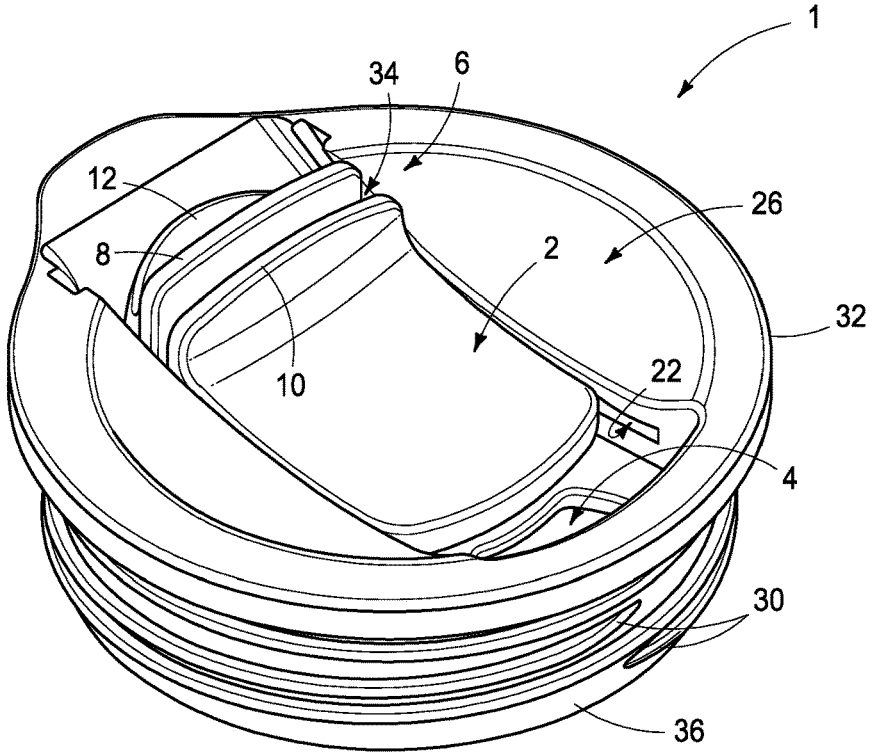

FIGS. 1-6 show an example implementation described herein as lid 1. Lid 1 is a dispensing lid for use with a liquid container. FIG. 1 shows a container 46 engaged with lid 1 in sealing association. A variety of containers may be engaged with lid 1 for holding a variety of liquids, such as water. A port 4 through lid 1 allows dispensing of liquids from container 46. A slider 2 in sliding engagement with lid 1 may be selectively movable between a closed position that closes port 4, an open position that opens port 4, and removal from lid 1. FIGS. 2 and 3 show slider 2 in a closed position while FIG. 5 shows slider 2 in an open position.

A variety of structures is conceivable that enable sliding engagement of slider 2 with lid 1. As an example, FIGS. 1-6 show one implementation with a sliding engagement that includes a pair of tracks 22 in lid 1. One track of the pair is not fully visible in FIGS. 1-6. Slider 2 includes a corresponding pair of tabs 24 on opposing sides of slider 2 that engage with tracks 22. As another example, FIGS. 1-6 show one implementation with tracks 22 and tabs 24 curved. Alternatively, the tracks and tabs could be linear.

Tracks 22 are in a recess 26 forming a portion of lid 1 with a lower elevational level compared to surrounding portions of lid 1. In some implementations, tracks extend upward, as shown for tracks 22 in FIG. 2. Additionally, as shown in FIG. 2, tracks 22 may extend from a low point approximately in the middle of recess 26 upward toward a rim 32 of lid 1. That is, from the approximate middle, tracks 22 extend upward to port 4 next to rim 32, as well as upward in the opposite direction to rim 32 on the side of lid 1 opposite port 4.

Slider 2 has a detent 6 that includes a wall 10 extending from slider 2 and a lever 8 attached to slider 2 at a pivot 14. Lever 8 is in an orientation opposing wall 10 with a gap 34 between lever 8 and wall 10 when lever 8 is in a released position, as shown in FIGS. 2, 3, and 5. Detent 6 further includes a pawl 12 extending from lever 8 and a catch 16 extending from pawl 12. Catch 16 engages a first stop 18 in lid 1 when slider 2 is in the closed position with lever 8 released. Catch 16 engages a second stop 20 in lid 1 when slider 2 is in the open position with lever 8 released. Catch 16 does not engage lid 1 when slider 2 is removed. FIGS. 2 and 3 show slider 2 in the closed position with lever 8 released and FIG. 5 shows slider 2 in the open position with lever 8 released.

A gasket 28, shown in the exploded view of FIG. 1, may fit into slider 2, as shown in FIG. 2, and provide a seal over port 4, retaining liquids within container 46, or some other container that may engage with lid 1. A variety of structures may be relied upon to engage lid 1 with a liquid container. In some implementations, as shown in FIGS. 2 and 3-6, threads 30 may engage lid 1 with a liquid container. As such, port 4 may be formed through a top wall of lid 1 and lid 1 may further include a circumscribing side wall 36 extending from the top wall. Lid 1 may selectively detach from the liquid container and engage side wall 36 with the liquid container in sealing association.

In FIGS. 2 and 3-6, threads 30 are shown on an external side of side wall 36. A corresponding threaded structure may be provided on an internal wall of a liquid container. In contrast, threads 30, or a similar threaded engagement, may instead be provided on an internal side of side wall 36. A corresponding threaded structure may be provided on an external wall of a liquid container. A gasket (not shown) might be provided between lid 1 and a liquid container to seal the engagement.

Recess 26 in lid 1 accommodates a user's nose to decrease the degree to which a user tilts their head back to dispense liquid into their mouth. In FIGS. 1-6, recess 26 is formed in a portion of lid 1 with a lower elevational level compared to surrounding portions of lid 1. Port 4 is positioned in recess 26, as is slider 2 when in the closed position, as apparent from FIGS. 2 and 3.

From the closed position in FIG. 3, FIG. 4 shows pinching lever 8 together with wall 10, closing gap 34, and disengaging catch 16 from first stop 18. With catch 16 disengaged, slider 2 is movable to second stop 20, the open position. Once slider 2 moves past first stop 18, a user may release lever 8 and simply push wall 10 toward second stop 20. In some implementations, the pivot biases the lever into the released position. With lever 8 biased, a user pushing wall 10 from first stop 18 toward second stop 20 after releasing catch 16 may recognize when catch 16 "snaps" into second stop 20.

As one example of a biased lever, FIG. 2 shows pivot 14 with a living hinge biasing lever 8 into the released position. As the term is used herein, "living hinge" refers to a thin flexible hinge or flexure bearing connecting two features. The living hinge may be made from the same material as two rigid pieces that it connects and, in that sense, may be referred to as an "integral living hinge", but integrality is otherwise not a requirement herein. For an integral living hinge, polypropylene might be selected as the continuous material in common among the components of slider 2, including detent 6, such as wall 10, lever 8, and pivot 14. Pawl 14 and catch 16 might be formed from the same continuous material as well. Polypropylene may provide the flexibility and resilience that enable biasing lever 8 into the released position while still enduring the potentially damaging conditions of household dishwashing machines.

Figure 6:
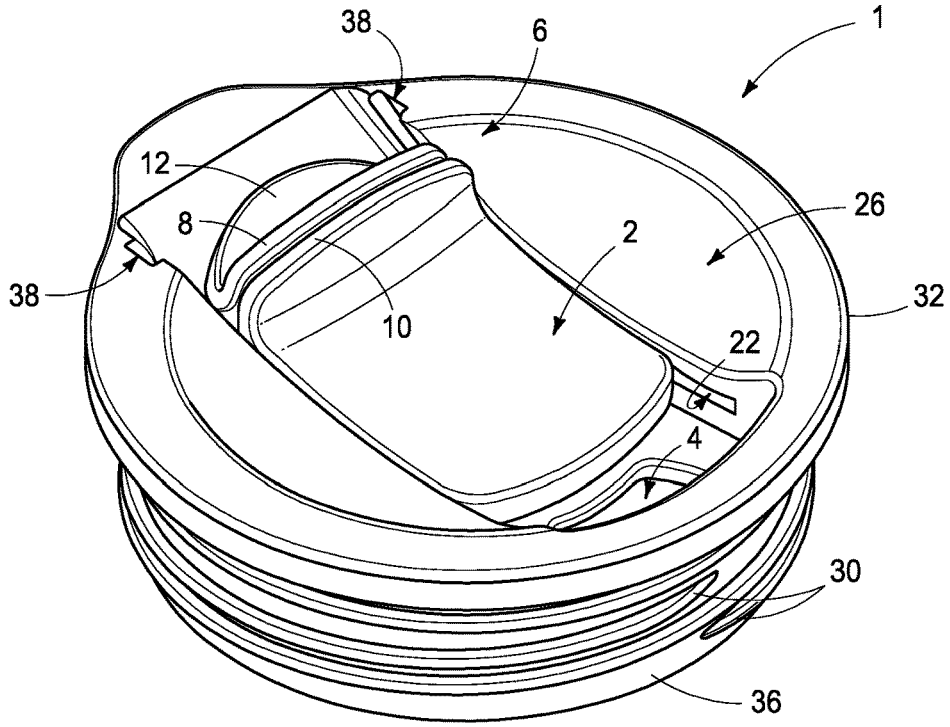

FIG. 5 shows slider 2 in the open position with catch 16 engaged with second stop 20 and lever 8 in the released position. FIG. 6 shows pinching lever 8 together with wall 10, closing gap 34, and disengaging catch 16 from second stop 20. With catch 16 disengaged, slider 2 may continue to slide along tracks 22, removing slider 2 from lid 1. Once slider 2 moves past second stop 20, a user may release lever 8 and simply push wall 10 toward removal.

In some implementations, as shown in the example of FIGS. 1-6, tracks 22 extend upward from recess 26 to rim 32 of lid 1 from which the pair of tabs 24 may slide out of engagement through a pair of open ends 38 of tracks 22. Slider 2 may return to lid 1 simply by re-engaging tabs 24 with tracks 22 and moving slider 2 into either the open position or the closed position. In some implementations, it is conceivable that more than one catch and/or more than two stops may be used. However, in the example of FIGS. 1-6, the catch consists of one catch 16, the first stop consists of one first stop 18, and the second stop consists of one second stop 20.

As described herein, lid 1 of the example implementation increases the ease of use as well as increases the ease of cleaning with a removable slider having a detent enabling selection of a closed position, an open position, or removal from the lid. Therefore, spilling of contents and soiling, damage, or loss of the slider may be reduced while still permitting slider removal, such as for cleaning.

Figure 7:
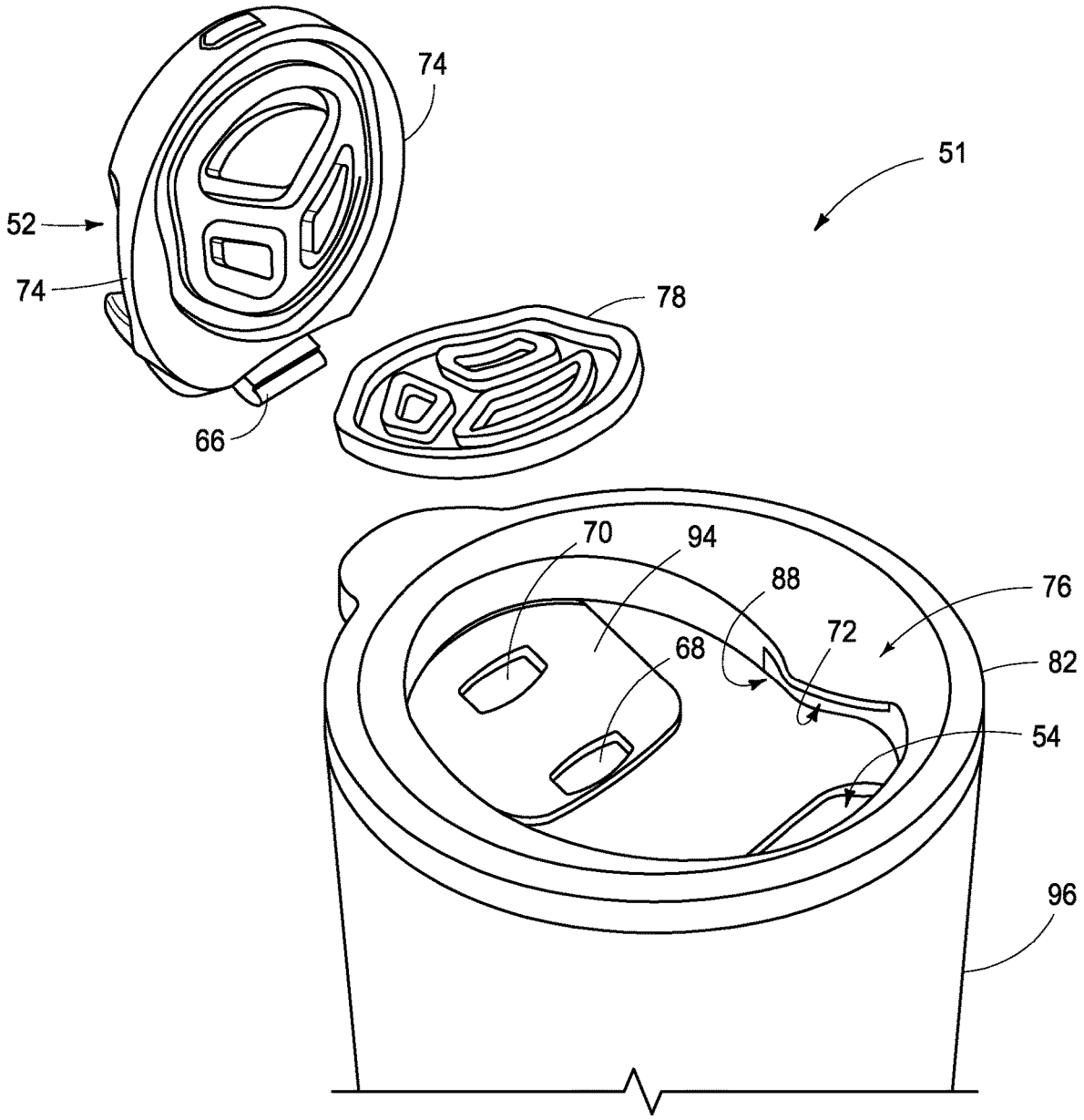
FIG. 7 is an exploded, isometric view of a dispensing lid, according to another implementation, engaged with a liquid container.
Figure 8A:
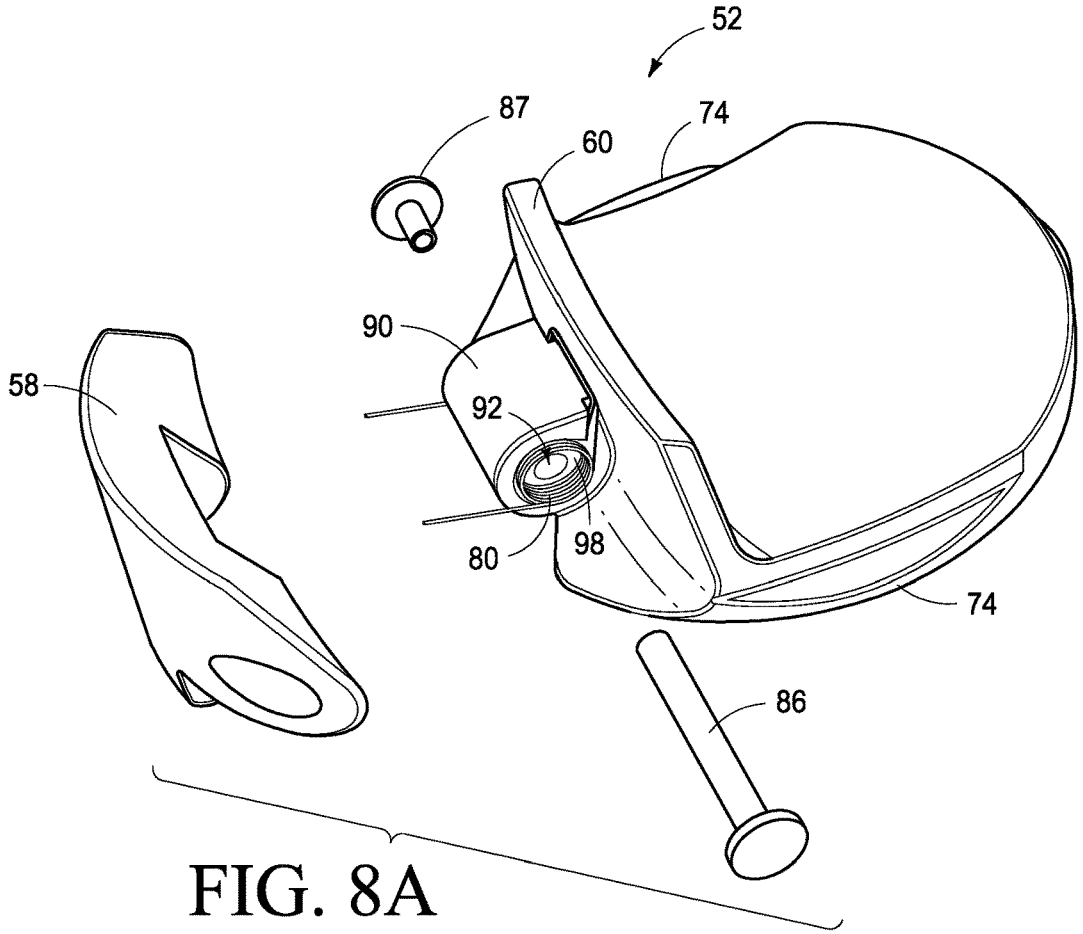
FIG. 8*a* is an exploded, isometric view of a slider 52 of the dispensing lid in FIG. 7.
Figure 8B:
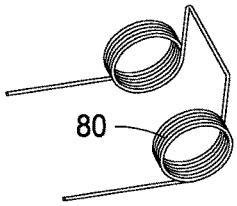
FIG. 8*b* is an isometric view of a spring 80 of the slider in FIG. 8*a*.
Figure 9:
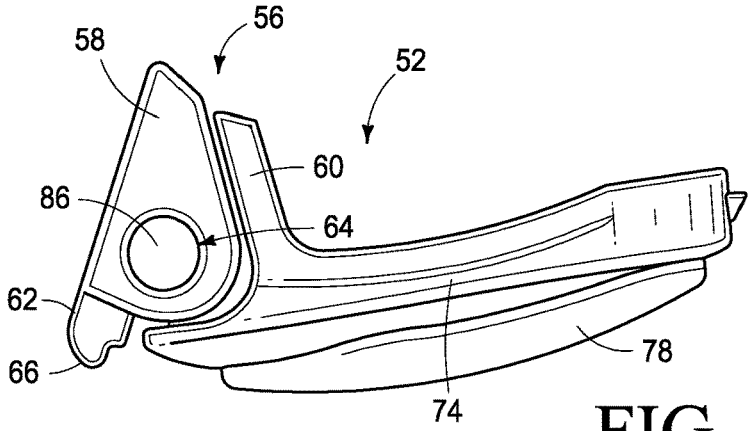
FIG. 9 is a side view of slider 52 of FIG. 8*a*.
Figure 10:
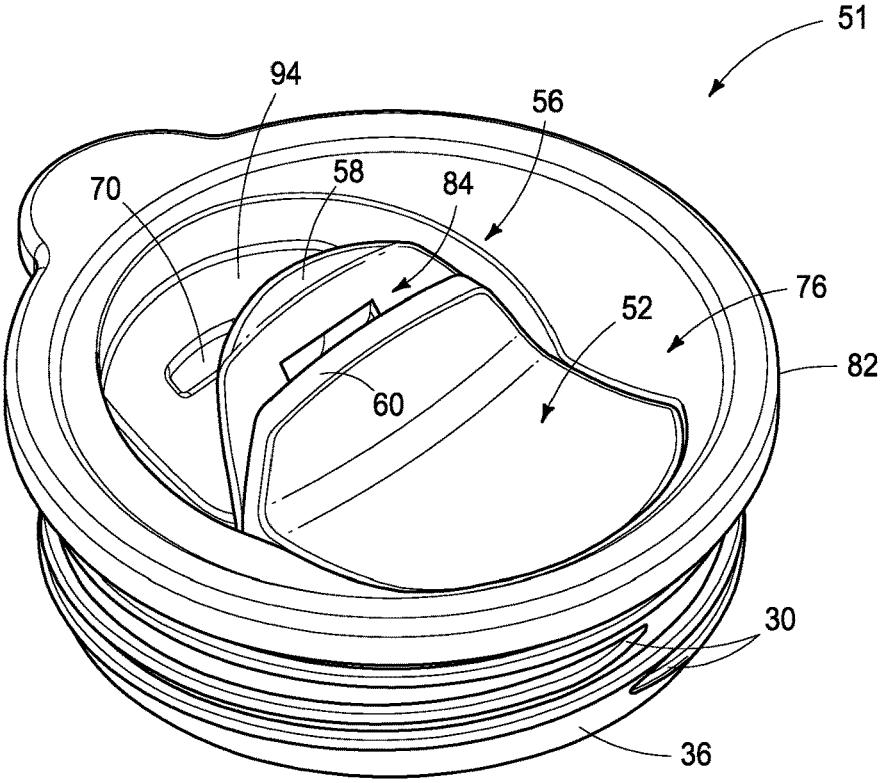
FIGS. 10-13 are isometric views of the dispensing lid in FIG. 7 with a slider 52 in various positions and modes of operation.
Figure 11:
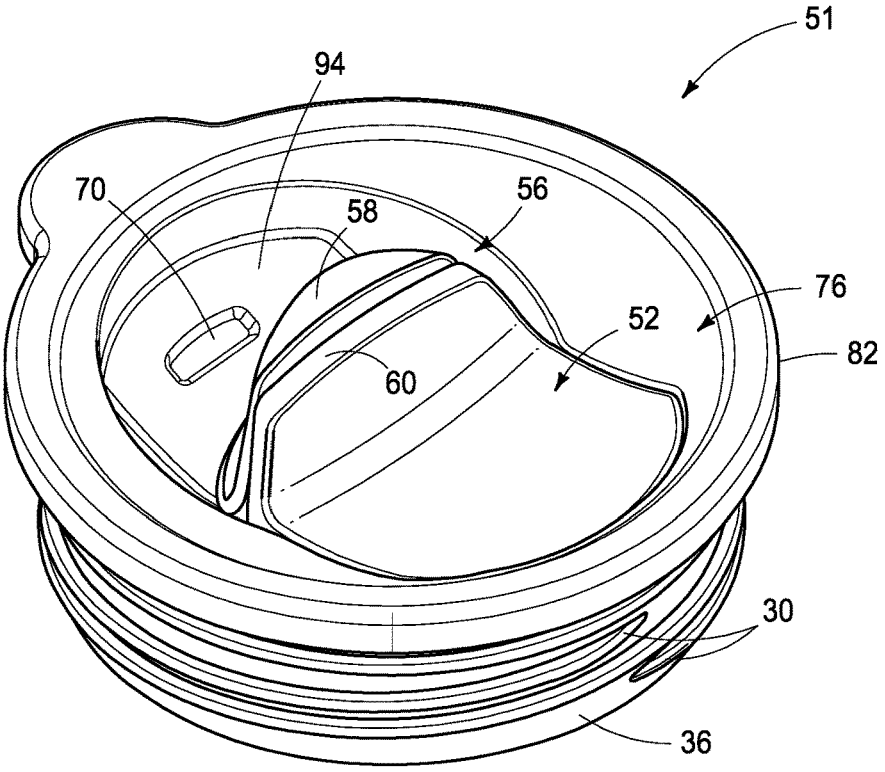
Figure 12:
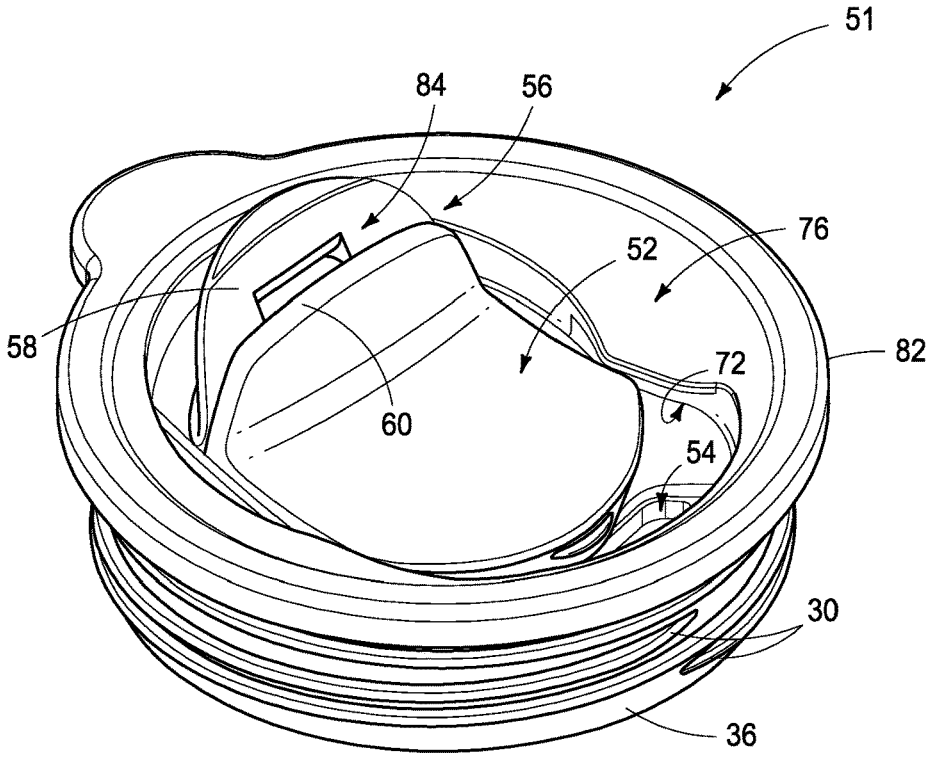

FIGS. 7-13 show an example implementation described herein as lid 51. Lid 51 is a dispensing lid for use with a liquid container. FIG. 7 shows a container 96 engaged with lid 51 in sealing association. A variety of containers may be engaged with lid 51 for holding a variety of liquids, such as water. A port 54 through lid 51 allows dispensing of liquids from container 96. A slider 52 in sliding engagement with lid 51 may be selectively movable between a closed position that closes port 54, an open position that opens port 54, and removal from lid 51. FIG. 10 shows slider 52 in a closed position while FIG. 12 shows slider 52 in an open position.

A variety of structures is conceivable that enable sliding engagement of slider 52 with lid 51. As an example, FIGS. 7-13 show one implementation with a sliding engagement that includes a pair of tracks 72 in lid 51. One track of the pair is not visible in FIGS. 7-13. Slider 52 includes a corresponding pair of tabs 74 on opposing sides of slider 52 that engage with tracks 72. As another example, FIGS. 7-13 show one implementation with tracks 72 and tabs 74 curved. Alternatively, the tracks and tabs could be linear.

Tracks 72 are in a recess 76 forming a portion of lid 51 with a lower elevational level compared to surrounding portions of lid 51. In some implementations, tracks extend upward, as shown for tracks 72 in FIG. 1. Additionally, as shown in FIG. 1, tracks 72 may extend from a low point approximately in the middle of recess 76 upward toward a rim 82 of lid 51.

Slider 52 has a detent 56 that includes a wall 60 extending from slider 52 and a lever 58 attached to slider 52 at a pivot 64. Lever 58 is in an orientation opposing wall 60 with a gap 84 between lever 58 and wall 60 when lever 58 is in a released position, as shown in FIGS. 10 and 12. Detent 56 further includes a pawl 62 extending from lever 58 and a catch 66 extending from pawl 62. Catch 66 engages a first stop 68 in lid 51 when slider 52 is in the closed position with lever 58 released. Catch 66 engages a second stop 70 in lid 51 when slider 52 is in the open position with lever 58 released. Catch 66 does not engage lid 51 when slider 52 is removed. FIG. 10 shows slider 52 in the closed position with lever 58 released and FIG. 12 shows slider 52 in the open position with lever 58 released.

A gasket 78, shown in the exploded view of FIG. 7, may fit into slider 52, as shown in FIG. 9, and provide a seal over port 54, retaining liquids within container 96, or some other container that may engage with lid 51. A variety of structures may be relied upon to engage lid 51 with a liquid container. In some implementations, as shown in FIGS. 10-14, threads 30 may engage lid 51 with a liquid container. As such, port 54 may be formed through a top wall of lid 51 and lid 51 may further include a circumscribing side wall 36 extending from the top wall. Lid 51 may selectively detach from the liquid container and engage side wall 36 with the liquid container in sealing association.

In FIGS. 10-14, threads 30 are shown on an external side of side wall 36. A corresponding threaded structure may be provided on an internal wall of a liquid container. In contrast, threads 30, or a similar threaded engagement, may instead be provided on an internal side of side wall 36. A corresponding threaded structure may be provided on an external wall of a liquid container. A gasket (not shown) might be provided between lid 51 and a liquid container to seal the engagement.

Recess 76 in lid 51 accommodates a user's nose to decrease the degree to which a user tilts their head back to dispense liquid into their mouth. In FIGS. 7-13, recess 76 is formed in a portion of lid 51 with a lower elevational level compared to surrounding portions of lid 51. Port 54 is positioned in recess 76, as is slider 52 when in the closed position, as apparent from FIG. 10.

From the closed position in FIG. 10, FIG. 11 shows pinching lever 58 together with wall 60, closing gap 84, and disengaging catch 66 from first stop 68. With catch 66 disengaged, slider 52 is movable to second stop 70, the open position. Once slider 52 moves past first stop 68, a user may release lever 58 and simply push wall 60 toward second stop 70. In some implementations, the pivot biases the lever into the released position. With lever 58 biased, a user pushing wall 60 from first stop 68 toward second stop 70 after releasing catch 66 may recognize when catch 66 "snaps" into second stop 70.

As one example of a biased lever, FIGS. 8*a*, 8*b*, and 9 show pivot 64 with a spring 80 biasing lever 58 into the released position. Pivot 64 includes an extension 90 from wall 60, a hole 92 through extension 90, and a pin 86 though lever 58 and hole 92. Pin 86 fixes lever 58 rotationally to extension 90. Other rotationally fixing mechanisms are conceivable. In some implementations, a pin cap 87 may secure pin 86 in hole 92. Other securing mechanisms are conceivable. In some implementations, as shown in the example of FIGS. 8*a* and 8*b*, spring 80 may be a hidden double spring. That is, opposing coils of spring 80 may nest within opposing recesses 98 of extension 90. Hole 92 may be centered within recesses 98.

Figure 13:
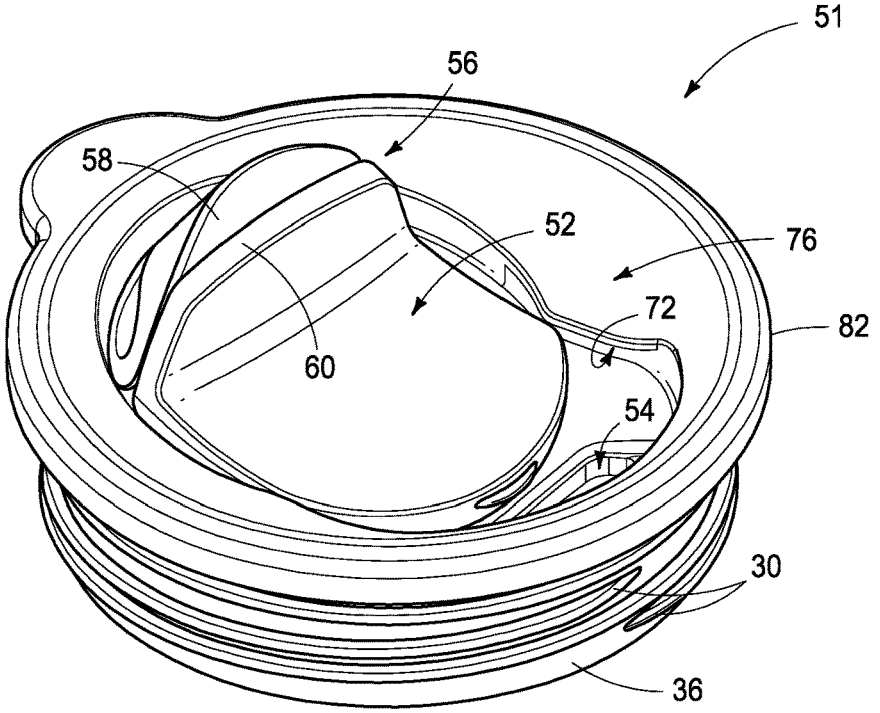

FIG. 12 shows slider 52 in the open position with catch 66 engaged with second stop 70 and lever 58 in the released position. FIG. 13 shows pinching lever 58 together with wall 60, closing gap 84, and disengaging catch 66 from second stop 70. With catch 66 disengaged, slider 52 may continue to slide along tracks 72 to a position where slider 52 may be lifted from lid 51. Once slider 52 moves past second stop 70, a user may release lever 58 and simply push wall 60 toward rim 82 before lifting slider 52 out of recess 76.

In some implementations, as shown in the example of FIGS. 7-13, tracks 72 extend to a landing 94 within recess 76 from which tabs 24 may slide out of engagement through a pair of open ends 88 of tracks 72. Slider 52 may return to lid 51 simply by re-engaging tabs 74 with tracks 72 and moving slider 52 into either the open position or the closed position. In some implementations, it is conceivable that more than one catch and/or more than two stops may be used. However, in the example of FIGS. 7-13, the catch consists of one catch 66, the first stop consists of one first stop 68, and the second stop consists of one second stop 70.

As described herein, lid 51 of the example implementation increases the ease of use as well as increases the ease of cleaning with a removable slider having a detent enabling selection of a closed position, an open position, or removal from the lid. Therefore, spilling of contents and soiling, damage, or loss of the slider may be reduced while still permitting slider removal, such as for cleaning.

Figure 14:
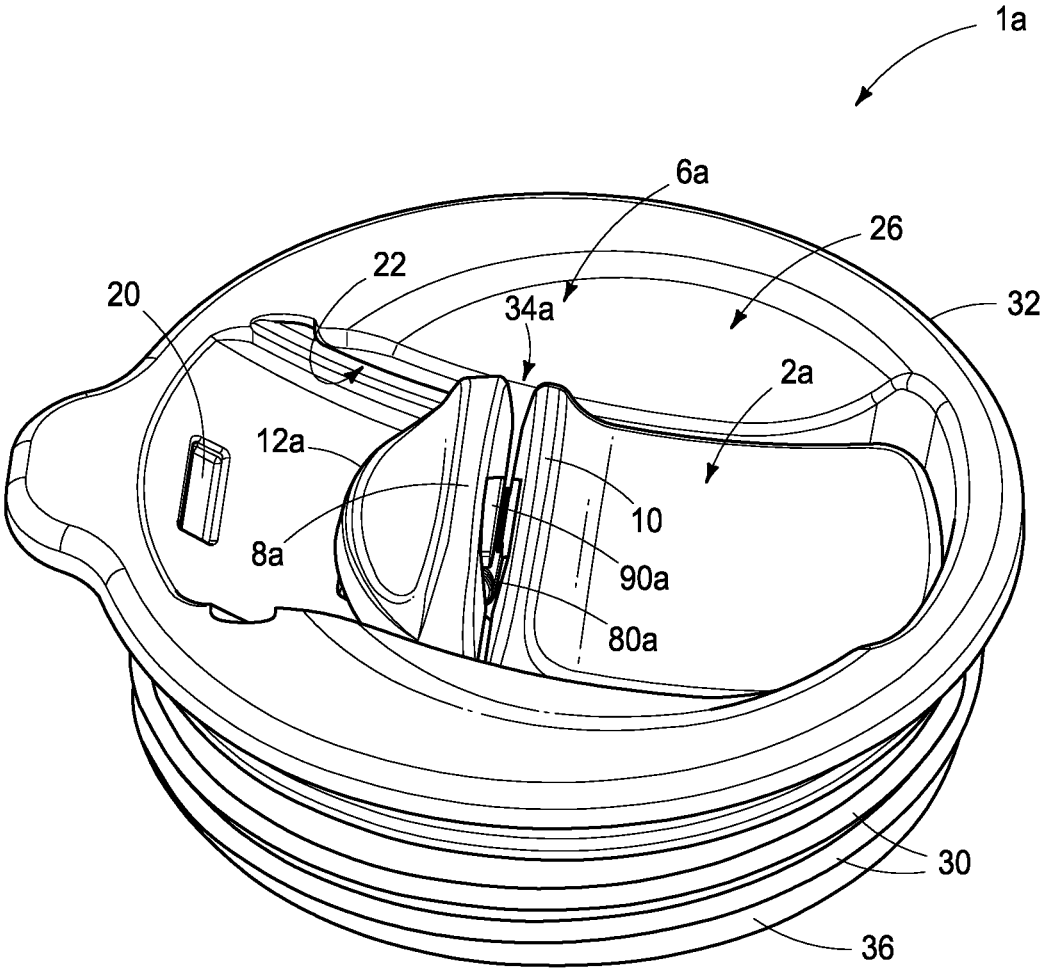
FIG. 14 is an isometric view of a dispensing lid, according to a further implementation.

In a further implementation, some features of the implementation of FIGS. 7-13 may be included in the implementation of FIGS. 1-6. For example, FIG. 14 shows an implementation described herein as lid 1*a*. Lid 1*a* is the same as lid 1 except that slider 2*a* is altered compared to slider 2. Instead of detent 6 of FIGS. 1-6, slider 2*a* includes a detent 6*a* incorporating the features of detent 56 from FIGS. 7-13. Specifically, slider 2*a* replaces pivot 14 of FIGS. 1-6 having a living hinge biasing lever 8 into the released position. Instead, slider 2*a* uses a pivot like that of pivot 64 from FIGS. 7-13 having a spring 80*a* biasing a lever 8*a* into the released position. Lever 8*a* is in an orientation opposing wall 10 with a gap 34*a* between lever 8*a* and wall 10 when lever 8*a* is in a released position, as shown in FIG. 14.

Like FIGS. 7-13 the pivot in FIG. 14 includes an extension 90*a* from wall 10, a hole (not shown) through extension 90*a*, and a pin (not shown) though lever 8*a* and the hole. In the implementation of FIG. 14, extension 90*a* is like extension 90, the hole is like hole 92, and the pin is like pin 86. The pin fixes lever 8*a* rotationally to extension 90*a*. Detent 6*a* further includes a pawl 12*a* extending from lever 8*a* and a catch (not shown) like catch 16 extending from pawl 12*a*. As with lid 1, the catch of lid 1*a* engages a first stop (not shown) like first stop 18 when slider 2*a* is in the closed position with lever 8*a* released.

As described herein, lid 1*a* of the example implementation increases the ease of use as well as increases the ease of cleaning with a removable slider having a detent enabling selection of a closed position, an open position, or removal from the lid. Therefore, spilling of contents and soiling, damage, or loss of the slider may be reduced while still permitting slider removal, such as for cleaning.

Devices and Methods

The discoveries described herein identify a number of solutions that may be implemented in devices and methods also described herein. Multiple solutions may be combined for implementation, enabling still further devices and methods. The inventors expressly contemplate that the various options described herein for individual devices and methods are not intended to be so limited except where incompatible with other devices and methods. The features and benefits of individual devices herein may also be used in combination with methods and other devices described herein even though not specifically indicated elsewhere. Similarly, the features and benefits of individual methods herein may also be used in combination with devices and other methods described herein even though not specifically indicated elsewhere.

Device A is a dispensing lid for use with a liquid container. The lid includes a port through the lid, a slider in sliding engagement with the lid, and a detent on the slider. The slider is selectively movable between a closed position that closes the port, an open position that opens the port, and removal from the lid. The detent includes a wall extending from the slider, a lever attached to the slider at a pivot, a pawl extending from the lever, and a catch extending from the pawl. The lever is in an orientation opposing the wall with a gap between the lever and the wall when the lever is in a released position. The catch engages a first stop in the lid when the slider is in the closed position with the lever released, engages a second stop in the lid when the slider is in the open position with the lever released, and does not engage the lid when the slider is removed.

Additional features may be implemented in Device A. By way of example, the port may be through a top wall of the lid and the lid may further include a circumscribing side wall extending from the top wall, the lid being selectively detachable from the liquid container and engagable via the side wall with the liquid container in sealing association. The lid may include a recessed portion with a lower elevational level compared to surrounding portions of the lid, the port being positioned in the recess along with the slider, when in the closed position.

The sliding engagement may include a pair of tracks in the lid and the slider may further include a corresponding pair of tabs on opposing sides of the slider that engage with the pair of tracks. The pair of tracks and the pair of tabs may be curved. Additionally, the pair of tracks may be in a recessed portion of the lid with a lower elevational level compared to surrounding portions of the lid, the pair of tracks extending upward. In one implementation, the pair of tracks extend upward from the recessed portion to a rim of the lid from which the pair of tabs may slide out of engagement through a pair of open ends of the pair of tracks. In another implementation, the pair of tracks extend to a landing within the recessed portion of the lid from which the pair of tabs may slide out of engagement through a pair of open ends of the pair of tracks.

The catch may consist of one catch, the first stop may consist of one first stop, and the second stop may consist of one second stop. The pivot may bias the lever into the released position. In one implementation, the pivot may include a living hinge biasing the lever into the released position. In another implementation, the pivot includes an extension from the wall, a hole through the extension, a pin through the lever and the hole, and a spring biasing the lever into the released position. The pin may fix the lever rotationally to the extension.

The described additional features of Device A may also be implemented in other devices and methods herein.

Device B is a dispensing lid for use with a liquid container. The lid includes a port through the lid, a slider in sliding engagement with the lid, and a detent on the slider. The slider is selectively movable between a closed position that closes the port, an open position that opens the port, and removal from the lid. The sliding engagement includes a pair of tracks in the lid. The slider further includes a corresponding pair of tabs on opposing sides of the slider that engage with the pair of tracks. The detent includes a wall extending from the slider, a lever attached to the slider at a pivot, a pawl extending from the lever, and a catch extending from the pawl. The lever is in an orientation opposing the wall with a gap between the lever and the wall when the lever is in a released position, the pivot including a living hinge biasing the lever into the released position. The catch engages a first stop in the lid when the slider is in the closed position with the lever released, engages a second stop in the lid when the slider is in the open position with the lever released, and does not engage the lid when the slider is removed.

Additional features may be implemented in Device B. By way of example, the lid may further include a recessed portion with a lower elevational level compared to surrounding portions of the lid, the port being positioned in the recess along with the slider, when in the closed position.

The pair of tracks and the pair of tabs may be curved and the pair of tracks may be in a recessed portion of the lid with a lower elevational level compared to surrounding portions of the lid, the pair of tracks extending upward. Additionally, the pair of tracks may extend upward from the recessed portion to a rim of the lid from which the pair of tabs may slide out of engagement through a pair of open ends of the pair of tracks.

The described additional features of Device B may also be implemented in other devices and methods herein.

Device C is a dispensing lid for use with a liquid container. The lid includes a port through the lid, a slider in sliding engagement with the lid, and a detent on the slider. The slider is selectively movable between a closed position that closes the port, an open position that opens the port, and removal from the lid. The sliding engagement includes a pair of tracks in the lid. The slider further includes a corresponding pair of tabs on opposing sides of the slider that engage with the pair of tracks. The detent includes a wall extending from the slider, a lever attached to the slider at a pivot, a pawl extending from the lever, and a catch extending from the pawl. The lever is in an orientation opposing the wall with a gap between the lever and the wall when the lever is in a released position. The pivot includes an extension from the wall, a hole through the extension, a pin through the lever and the hole, and a spring biasing the lever into the released position. The pin fixes the lever rotationally to the extension. The catch engages a first stop in the lid when the slider is in the closed position with the lever released, engages a second stop in the lid when the slider is in the open position with the lever released, and does not engage the lid when the slider is removed.

Additional features may be implemented in Device C. By way of example, the lid may further include a recessed portion with a lower elevational level compared to surrounding portions of the lid, the port being positioned in the recess along with the slider, when in the closed position.

The pair of tracks and the pair of tabs may be curved and the pair of tracks may be in a recessed portion of the lid with a lower elevational level compared to surrounding portions of the lid, the pair of tracks extending upward. Additionally, the pair of tracks may extend to a landing within the recessed portion of the lid from which the pair of tabs may slide out of engagement through a pair of open ends of the pair of tracks. Alternatively, the pair of tracks may extend upward from the recessed portion to a rim of the lid from which the pair of tabs may slide out of engagement through a pair of open ends of the pair of tracks.

The described additional features of Device C may also be implemented in other devices and methods herein.

Although minima and maxima are listed for the above described ranges and other ranges designated herein, it should be understood that more narrow included ranges may also be desirable and may be distinguishable from prior art. Also, processing principles discussed herein may provide an additional basis for the lesser included ranges.

In compliance with the statute, the embodiments have been described in language more or less specific as to structural and methodical features. It is to be understood, however, that the embodiments are not limited to the specific features shown and described. The embodiments are, therefore, claimed in any of their forms or modifications within the proper scope of the appended claims appropriately interpreted in accordance with the doctrine of equivalents.

TABLE OF REFERENCE NUMERALS FOR FIGURES

| | |
|---|---|
| 1 | lid |
| 2 | slider |
| 4 | port |
| 6 | detent |
| 8 | lever |
| 10 | wall |
| 12 | pawl |
| 14 | pivot |
| 16 | catch |
| 18 | first stop |
| 20 | second stop |
| 22 | track |
| 24 | tab |
| 26 | recess |
| 28 | gasket |
| 30 | threads |
| 32 | rim |
| 34 | gap |
| 36 | side wall |
| 38 | open end |
| 46 | container |
| 51 | lid |
| 52 | slider |
| 54 | port |
| 56 | detent |
| 58 | lever |
| 60 | wall |
| 62 | pawl |
| 64 | pivot |
| 66 | catch |
| 68 | first stop |
| 70 | second stop |
| 72 | track |
| 74 | tab |
| 76 | recess |
| 78 | gasket |
| 80 | spring |
| 82 | rim |
| 84 | gap |
| 86 | pin |
| 87 | pin cap |
| 88 | open end |
| 90 | extension |
| 92 | hole |
| 94 | landing |
| 96 | container |
| 98 | recess |
| 1a | lid |
| 2a | slider |
| 6a | detent |
| 8a | lever |
| 12a | pawl |
| 34a | gap |
| 80a | spring |
| 90a | extension |

What is claimed is:

1. A dispensing lid for use with a liquid container, the lid comprising:

a port through the lid;

a slider in sliding engagement with the lid and selectively movable between a closed position that closes the port, an open position that opens the port, and removal from the lid; and a detent on the slider, the detent including:

a wall extending from the slider;

a lever attached to the slider at a pivot and in an orientation opposing the wall with a gap between the lever and the wall when the lever is in a released position;

a pawl extending from the lever; and a catch extending from the pawl, the catch engaging a first stop in the lid when the slider is in the closed position with the lever released, engaging a second stop in the lid when the slider is in the open position with the lever released, and not engaging the lid when the slider is removed.

2. The lid of claim 1, wherein the port is through a top wall of the lid and the lid further comprises a circumscribing side wall extending from the top wall, the lid being selectively detachable from the liquid container and engagable via the side wall with the liquid container in a sealing association.

3. The lid of claim 1, further comprising a recessed portion of the lid with a lower elevational level compared to surrounding portions of the lid, the port being positioned in the recess along with the slider, when in the closed position.

4. The lid of claim 1, wherein the sliding engagement comprises a pair of tracks in the lid and the slider further comprises a corresponding pair of tabs on opposing sides of the slider that engage with the pair of tracks.

5. The lid of claim 4, wherein the pair of tracks and the pair of tabs are curved and the pair of tracks are in a recessed portion of the lid with a lower elevational level compared to surrounding portions of the lid, the pair of tracks extending upward.

6. The lid of claim 5, wherein the pair of tracks extend upward from the recessed portion to a rim of the lid from which the pair of tabs may slide out of engagement through a pair of open ends of the pair of tracks.

7. The lid of claim 5, wherein the pair of tracks extend to a landing within the recessed portion of the lid from which the pair of tabs may slide out of engagement through a pair of open ends of the pair of tracks.

8. The lid of claim 1, wherein the catch consists of one catch, the first stop consists of one first stop, and the second stop consists of one second stop.

9. The lid of claim 1, wherein the pivot biases the lever into the released position.

10. The lid of claim 1, wherein the pivot comprises a living hinge biasing the lever into the released position.

11. The lid of claim 1, wherein the pivot comprises:

an extension from the wall;

a hole through the extension;

a pin through the lever and the hole, the pin fixing the lever rotationally to the extension; and a spring biasing the lever into the released position.

12. A dispensing lid for use with a liquid container, the lid comprising:

a port through the lid;

a slider in sliding engagement with the lid and selectively movable between a closed position that closes the port, an open position that opens the port, and removal from the lid, the sliding engagement including a pair of tracks in the lid and the slider further comprises a corresponding pair of tabs on opposing sides of the slider that engage with the pair of tracks; and a detent on the slider, the detent including:

a wall extending from the slider;

a lever attached to the slider at a pivot and in an orientation opposing the wall with a gap between the lever and the wall when the lever is in a released position, the pivot including a living hinge biasing the lever into the released position;

a pawl extending from the lever; and a catch extending from the pawl, the catch engaging a first stop in the lid when the slider is in the closed position with the lever released, engaging a second stop in the lid when the slider is in the open position with the lever released, and not engaging the lid when the slider is removed.

13. The lid of claim 12, further comprising a recessed portion of the lid with a lower elevational level compared to surrounding portions of the lid, the port being positioned in the recess along with the slider, when in the closed position.

14. The lid of claim 12, wherein the pair of tracks and the pair of tabs are curved and the pair of tracks are in a recessed portion of the lid with a lower elevational level compared to surrounding portions of the lid, the pair of tracks extending upward.

15. The lid of claim 14, wherein the pair of tracks extend upward from the recessed portion to a rim of the lid from which the pair of tabs may slide out of engagement through a pair of open ends of the pair of tracks.

16. A dispensing lid for use with a liquid container, the lid comprising:

a port through the lid;

a slider in sliding engagement with the lid and selectively movable between a closed position that closes the port, an open position that opens the port, and removal from the lid, the sliding engagement including a pair of tracks in the lid and the slider further comprises a corresponding pair of tabs on opposing sides of the slider that engage with the pair of tracks; and a detent on the slider, the detent including:

a wall extending from the slider;

a lever attached to the slider at a pivot and in an orientation opposing the wall with a gap between the lever and the wall when the lever is in a released position, the pivot including:

an extension from the wall;

a hole through the extension;

a pin through the lever and the hole, the pin fixing the lever rotationally to the extension; and a spring biasing the lever into the released position;

a pawl extending from the lever; and a catch extending from the pawl, the catch engaging a first stop in the lid when the slider is in the closed position with the lever released, engaging a second stop in the lid when the slider is in the open position with the lever released, and not engaging the lid when the slider is removed.

17. The lid of claim 16, further comprising a recessed portion of the lid with a lower elevational level compared to surrounding portions of the lid, the port being positioned in the recess along with the slider, when in the closed position.

18. The lid of claim 16, wherein the pair of tracks and the pair of tabs are curved and the pair of tracks are in a recessed portion of the lid with a lower elevational level compared to surrounding portions of the lid, the pair of tracks extending upward.

19. The lid of claim 18, wherein the pair of tracks extend to a landing within the recessed portion of the lid from which the pair of tabs may slide out of engagement through a pair of open ends of the pair of tracks.

20. The lid of claim 18, wherein the pair of tracks extend upward from the recessed portion to a rim of the lid from which the pair of tabs may slide out of engagement through a pair of open ends of the pair of tracks.

* * * * *